United States Patent [19]

Zitta

[11] Patent Number: 4,931,718

[45] Date of Patent: Jun. 5, 1990

[54] CMOS VOLTAGE REFERENCE

[75] Inventor: Heinz Zitta, Drobollach, Austria

[73] Assignee: Siemens Aktiengesellschaft, Munich, Fed. Rep. of Germany

[21] Appl. No.: 412,894

[22] Filed: Sep. 26, 1989

[30] Foreign Application Priority Data

Sep. 26, 1988 [EP] European Pat. Off. ..... 88115839.8

[51] Int. Cl.[5] ..... G05F 3/30

[52] U.S. Cl. ..... 323/313; 323/314; 307/296.1

[58] Field of Search ..... 323/311, 312, 313, 316, 323/901, 907; 307/296.1, 296.5, 296.6, 296.7, 296.8

[56] References Cited

U.S. PATENT DOCUMENTS

| | | | |
|---|---|---|---|
| 4,317,054 | 2/1982 | Caruso et al. | 323/313 X |
| 4,588,941 | 5/1986 | Kerth et al. | 323/314 |
| 4,590,418 | 5/1986 | Moriarty et al. | 323/313 |
| 4,590,419 | 5/1986 | Moriarty | 323/313 |
| 4,602,207 | 7/1986 | Kim et al. | 323/313 |
| 4,622,512 | 11/1986 | Brokaw | 323/313 |
| 4,626,770 | 12/1986 | Price, Jr. | 323/313 |
| 4,751,454 | 6/1988 | Dielacher et al. | 323/314 |
| 4,797,577 | 1/1989 | Hing | 323/313 X |
| 4,857,823 | 8/1989 | Bitting | 323/314 |

*Primary Examiner*—Patrick R. Salce

*Assistant Examiner*—Emanuel Todd Voeltz

*Attorney, Agent, or Firm*—Herbert L. Lerner; Laurence A. Greenberg

[57] ABSTRACT

A circuit configuration in complementary MOS technology for generating a reference voltage independent of temperature with the aid of a bandgap circuit includes first and second bipolar transistors having first and second base-to-emitter threshold voltages and interconnected base connections, and first and second field effect transistors. A first series circuit includes the output circuit of the first bipolar transistor, a first resistor being connected to the first bipolar transistor and defining a first connecting point therebetween, and the output circuit of the first field effect transistor being connected between terminals of a supply voltage source. A second series circuit which is parallel to the first includes the output circuit of the second bipolar transistor, series-connected second and third resistors defining a second connecting point therebetween, and the output circuit of the second field effect transistor. An operational amplifier has inputs connected to the first and second connecting points and an output controlling the field effect transistors. A bandgap circuit has an output at the drain connection of the second field effect transistor being fed back to the base connections of the bipolar transistors.

5 Claims, 1 Drawing Sheet

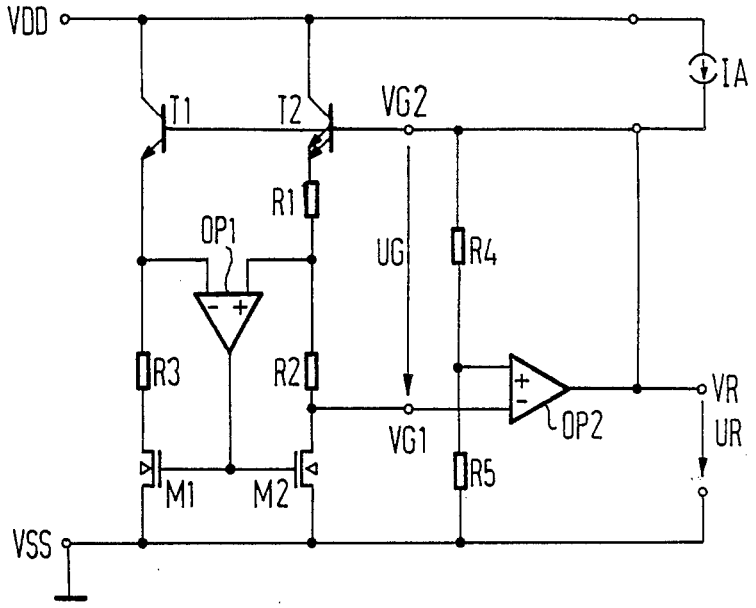
VDD
IA
T1
T2
VG2
R1
OP1
UG
R4
R3
R2
VR
OP2
UR
VG1
R5
M1
M2
VSS

CMOS VOLTAGE REFERENCE

SPECIFICATION

The invention relates to a circuit configuration in complementary MOS technology for generating a reference voltage independent of temperature with the aid of a bandgap circuit, including a series circuit being located between terminals of a supply voltage source and being formed of the output circuit of a first bipolar transistor having a first base-to-emitter threshold voltage, a resistor, and the output circuit of a first field effect transistor, a series circuit correspondingly parallel thereto being formed of the output circuit of a second bipolar transistor having a second base-to-emitter threshold voltage, two series-connected resistors, and the output circuit of a second field effect transistor, the base connections of the bipolar transistors being connected to one another and the connecting points between the first bipolar transistor and the first resistor as well as between the two series-connected resistors being applied to inputs of a first operational amplifier having an output controlling the two field effect transistors.

Bandgap circuits are known and are described, for instance, in the book entitled "Halbleiter-Schaltungstechnik" [Semiconductor Circuitry] by U. Tietze and Ch. Schenk, 7th Edition, Springer-Verlag, Berlin, Heidelberg, New York, 1985, pp. 534 ff.

That book explains that reference voltages can be generated with such bandgap circuits that furnish a reference voltage independent of temperature regardless of the temperature coefficients of the components used therein. The principle behind such circuits is that the negative temperature coefficient of the base-to-emitter diode voltage of a bipolar transistor is compensated for by the addition of a voltage of correspondingly positive temperature coefficient, by using a second transistor with a different base-to-emitter voltage and an emitter resistor.

A bandgap circuit in complementary CMOS technology as is generically described above, is known from the IEEE ISSC publication, Vol. SC-20, No. 6, Dec. 1985, pp. 1151–1157. The different base-to-emitter voltages of the bipolar transistors are generated, for instance, by different surface area ratios of the emitter zones. The circuit relates to a p-well CMOS technique, such as can be made, for instance, on an $n^-$-conductive substrate or a correspondingly conductive epitactic film. N-channel field effect transistors are produced by incorporating $p^+$-zones for the source and drain into the substrate. In order to produce p-channel field effect transistors, a $p^-$-conducting well is required, into which $n^+$-conducting zones can be incorporated for the source and drain connections. Bipolar transistors can be made by this technique by incorporating a $p^-$-conducting well on the $n^-$-conducting substrate and an $n^+$-conducting connection zone into the $p^-$-conducting well. In this way, a substrate n-p-n transistor is created, in which the $n^+$-zone is the emitter, the $p^-$-well is the base and the substrate is the collector. The collector or substrate must be connected to the positive operating voltage, in order to reliably block out parasitic diodes between the p-wells and the substrate.

The CMOS bandgap circuit known from the above-mentioned prior publication uses the base connections of the two n-p-n transistors as the reference point for the bandgap voltage. Typically, this point is applied to the reference potential, or in other words ground. The output connection of the bandgap voltage is applied to the connecting point of the drain connection of an MOS transistor having a resistor, both of which are disposed in the emitter circuit of a bipolar transistor. In each case, the known CMOS bandgap circuit requires one supply voltage which is positive and one supply voltage which is negative, each with respect to the reference potential.

On the other hand, bandgap circuits are known that are able to make do with only a single unipolar supply voltage, but to do so they cannot use bipolar transistors. Furthermore, these circuits do not attain the temperature stability of bipolar bandgap circuits.

It is accordingly an object of the invention to provide a CMOS voltage reference circuit, which overcomes the hereinafore-mentioned disadvantages of the heretofore-known devices of this general type and which makes do with a merely unipolar supply voltage, and yet attains the temperature stability of bipolar bandgap circuits.

With the foregoing and other objects in view there is provided, in accordance with the invention, a circuit configuration in complementary MOS technology for generating a reference voltage independent of temperature with the aid of a bandgap circuit, comprising first and second bipolar transistors having output circuits, respective first and second base-to-emitter threshold voltages and interconnected base connections, a first resistor being connected to the first bipolar transistor and defining a first connecting point therebetween, second and third series-connected resistors defining a second connecting point therebetween, first and second field effect transistors having output circuits and drain connections, a supply voltage source having terminals, a first series circuit including the output circuit of the first bipolar transistor, the first resistor, and the output circuit of the first field effect transistor being connected between the terminals of the supply voltage source, a second series circuit correspondingly parallel to the first series circuit including the output circuit of the second bipolar transistor, the series-connected second and third resistors, and the output circuit of the second field effect transistor, an operational amplifier having inputs connected to the first and second connecting points and an output controlling the field effect transistors, and a bandgap circuit having an output at the drain connection of the second field effect transistor being fed back to the base connections of the bipolar transistors.

The circuit configuration according to the invention has the advantage of being able to be operated at a lower and furthermore unipolar voltage with respect to the reference potential, and that even higher reference voltages than the bandgap voltage of the semiconductor material can be attained therewith.

In accordance with another feature of the invention, there is provided an ohmic voltage divider having a divider point, and a feedback branch through which the output of the bandgap circuit is fed back to the base connections of the bipolar transistors, one of the terminals of the supply voltage source having a relatively negative supply voltage potential and the other of the terminals having a relatively positive supply voltage potential, the ohmic voltage divider being connected between the base connections of the bipolar transistors and the terminal having a relatively low supply voltage potential, and the feedback branch having another operational amplifier with an input side connected to the output of the bandgap circuit and to the divider point of the ohmic voltage divider and an output side connected to the base connections of the bipolar transistors.

In accordance with a further feature of the invention, there is provided a startup circuit connected between the output side or connection of the second operational amplifier and the terminal having a relatively positive supply potential.

In accordance with a concomitant feature of the invention, the startup circuit is a current source or a resistor.

Other features which are considered as characteristic for the invention are set forth in the appended claims.

Although the invention is illustrated and described herein as embodied in a CMOS voltage reference, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing.

The drawing is a schematic circuit of a CMOS voltage reference according to the invention.

Referring now in detail to the single figure of the drawing, there is seen a bandgap circuit which includes first and second bipolar transistors T1 and T2 with different first and second base to emitter voltages. The collector terminals of both transistors are connected to a terminal VDD, which carries a positive potential as compared with the reference voltage. A first resistor R3 is disposed in the emitter circuit of the transistor T1, defining a first connection point therebetween. A field effect transistor Ml has an output circuit which is connected in series with the resistor R3 and a source which is applied to a terminal VSS. The terminal VSS is applied to a reference potential, that is to ground. The output circuit of the transistor T1, the first resistor R3 and the output circuit of the transistor Ml form a first series circuit between the terminals VDD and VSS. A series circuit formed of second and third resistors R1 and R2 having a second connection point therebetween and the output circuit of another field effect transistor M2, is disposed in the output circuit of the transistor T2 forming a second series circuit. The source connection of the field effect transistor M2 is also applied to the terminal VSS. A connecting point between the emitter of the transistor T1 and the resistor R3 on one hand, and a connecting point between the two resistors R1 and R2 on the other hand, lead to inputs of a first operational amplifier OP1, the output of which controls the transistors M1 and M2. A bandgap voltage UG can be picked up at the drain connection of the transistor M2 corresponding to a connection VG1 which is the output of a bandgap circuit, with reference to the base connections of the bipolar transistors T1 and T2 corresponding to a connection or reference point VG2.

According to the invention, the output VG1 of the bandgap circuit is fed back to the reference point VG2. To this end, the connection VG1 is connected to one input of a second operational amplifier OP2, the other input of which is located at the divider point of an ohmic or resistive voltage divider formed of resistors R4 and R5.

The ohmic voltage divider is connected between the connection VG2 and the terminal VSS, that is ground. The output of the operational amplifier OP2 is fed back to the connection VG2, that is to the base connections of the bipolar transistors T1 and T2.

At the same time, the output of the second operational amplifier OP2 is applied to a terminal VR, at which a reference voltage UR that is independent of temperature can be picked up, with respect to the reference potential present at the terminal VSS. The relationship between the temperature-independent reference voltage UR and the bandgap voltage UG is established by the resistive voltage divider formed of the resistors R4 and R5. The temperature-independent reference voltage UR can be calculated from the product of the bandgap voltage UG on one hand, and the sum of the two resistors R4 and R5, referred to the resistor R4 on the other hand.

An embodiment of the invention as shown in the drawing includes a startup circuit IA, which is connected between the output connection or terminal VR of the second operational amplifier OP2 and the terminal VDD having the relatively positive supply voltage potential. The startup circuit IA is shown as a current source and can, for instance, be in the form of a current source transistor or a resistor. The startup circuit IA makes it possible to use the reference voltage UR as the operating voltage of the bandgap circuit, so that the actual reference voltage source formed of the two bipolar transistors T1 and T2 can be operated with the stabilized output reference voltage. In this way, excellent suppression of input voltage fluctuations at the terminal VDD is obtained. The startup circuit IA is necessary because the operating voltage derived from the temperature-independent reference voltage UR must still be developed when a voltage is applied to the terminal VDD. The circuit according to the exemplary embodiment shown in the drawing makes it possible to dispense with the use of a separate connection terminal VR, so that the CMOS voltage reference according to the invention has only the two connection terminals VDD and VSS leading to the outside.

The foregoing is a description corresponding in substance to European Application No. 88 115 839.8, dated Sept. 26, 1988, the International priority of which is being claimed for the instant application, and which is hereby made part of this application. Any material discrepancies between the foregoing specification and the aforementioned corresponding European application are to be resolved in favor of the latter.

I claim:

1. Circuit configuration in complementary MOS technology for generating a reference voltage independent of temperature with the aid of a bandgap circuit, comprising first and second bipolar transistors having output circuits, respective first and second base-to-emitter threshold voltages and interconnected base connections, a first resistor being connected to said first bipolar transistor and defining a first connecting point therebetween, second and third series-connected resistors defining a second connecting point therebetween, first and second field effect transistors having output circuits and drain connections, a supply voltage source having terminals, a first series circuit including said output circuit of said first bipolar transistor, said first resistor, and said output circuit of said first field effect transistor being connected between said terminals of said supply voltage source, a second series circuit parallel to said first series circuit including said output circuit of said second bipolar transistor, said series-connected second and third resistors, and said output circuit of said second field effect transistor, an operational amplifier having inputs connected to said first and second connecting points and an output controlling said field effect transistors, and a bandgap circuit having an output at said drain connection of said second field effect transistor being fed back to said base connections of said bipolar transistors.

2. Configuration according to claim 1, including an ohmic voltage divider having a divider point, and a feedback branch through which said output of said bandgap circuit is fed back to said base connections of said bipolar transistors, one of said terminals of said supply voltage source having a relatively low supply voltage potential and the other of said terminals having a relatively high supply voltage potential, said ohmic voltage divider being connected between said base connections of said bipolar transistors and said terminal having a relatively low supply voltage potential, and said feedback branch having another operational amplifier with an input side connected to said output of said bandgap circuit and to said divider point of said ohmic voltage divider and an output side connected to said base connections of said bipolar transistors.

3. Configuration according to claim 2, including a startup circuit connected between said output side of said second operational amplifier and said terminal having a relatively high supply potential.

4. Configuration according to claim 3, wherein said startup circuit is a current source.

5. Configuration according to claim 3, wherein said startup circuit is a resistor.

* * * * *